US009526394B2

(12) United States Patent
Conrad

(10) Patent No.: US 9,526,394 B2
(45) Date of Patent: Dec. 27, 2016

(54) SURFACE CLEANING APPARATUS

(71) Applicant: G.B.D. Corporation, Nassau (BS)

(72) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 144 days.

(21) Appl. No.: 13/840,955

(22) Filed: Mar. 15, 2013

(65) Prior Publication Data

US 2014/0259510 A1 Sep. 18, 2014

(51) Int. Cl.
*A47L 13/22* (2006.01)
*A47L 11/40* (2006.01)

(52) U.S. Cl.
CPC ..... *A47L 13/225* (2013.01); *A47L 11/4008* (2013.01); *A47L 11/4011* (2013.01); *A47L 11/4086* (2013.01)

(58) Field of Classification Search
CPC .... A47L 11/4083; A47L 11/34; A47L 13/225; A47L 11/4011; A47L 11/4008
USPC ..... 15/320, 322, 324
See application file for complete search history.

(56) References Cited

U.S. PATENT DOCUMENTS 6,131,237 A * 10/2000 Kasper et al. ..... 15/320
6,253,414 B1 * 7/2001 Bradd et al. ..... 15/320
6,584,990 B2 7/2003 Shaw
6,898,820 B2 * 5/2005 Kasper et al. ..... 15/320
7,650,667 B2 1/2010 Rosenzweig et al.
7,811,022 B2 * 10/2010 Bobrosky ..... A47L 9/04 15/209.1
7,819,127 B1 * 10/2010 Huffman ..... A47L 11/34 134/198
8,205,293 B2 6/2012 Rosenzweig et al.
8,245,351 B2 8/2012 Rosenzweig et al.
8,261,402 B2 9/2012 Rosenzweig et al.
8,353,074 B2 1/2013 Krebs
8,458,850 B2 6/2013 Kasper et al.
8,534,301 B2 9/2013 Nottingham et al.
2002/0096201 A1 7/2002 Shaw
2005/0115014 A1 * 6/2005 Worwag ..... 15/324
2008/0034514 A1 2/2008 Rosenzweig et al.
2008/0066789 A1 3/2008 Rosenzweig et al.
2008/0236635 A1 10/2008 Rosenzweig et al.
2009/0000051 A1 1/2009 Rosenzweig et al.
2009/0223540 A1 9/2009 Rosenzweig et al.
2009/0320231 A1 12/2009 Rosenzweig et al.
2010/0024146 A1 2/2010 Rosenzweig et al.
(Continued)

FOREIGN PATENT DOCUMENTS

WO WO 2013/029040 A1 2/2013

OTHER PUBLICATIONS

US 8,082,621, 12/2011, Rosenzweig et al. (withdrawn)

*Primary Examiner* — Dung Van Nguyen
(74) *Attorney, Agent, or Firm* — Philip C. Mendes da Costa; Bereskin & Parr LLP/S.E.N.C.R.L., s.r.l.

(57) ABSTRACT

A surface cleaning apparatus may include a surface cleaning head including a cleaning pad mount that is configured to receive a cleaning pad. A steam distribution system may be provided and may include a steam unit in fluid communication with a water reservoir and may have a steam outlet in communication with the cleaning pad mount. A cleaning solution distribution system may be provided and may include a cleaning solution reservoir in communication with a dispensing outlet.

25 Claims, 6 Drawing Sheets

(56) References Cited

U.S. PATENT DOCUMENTS

| | | | | |
|---|---|---|---|---|
| 2010/0037495 | A1* | 2/2010 | Rosenzweig et al. | 38/77.8 |
| 2010/0126533 | A1 | 5/2010 | Nottingham et al. | |
| 2010/0287716 | A1 | 11/2010 | Kasper et al. | |
| 2011/0131753 | A1 | 6/2011 | Krebs | |
| 2012/0137465 | A1 | 6/2012 | Nolan et al. | |
| 2012/0145191 | A1 | 6/2012 | Williams et al. | |
| 2012/0151703 | A1 | 6/2012 | Chow | |
| 2013/0091647 | A1 | 4/2013 | Yuan | |
| 2013/0167319 | A1 | 7/2013 | Tang | |
| 2013/0209075 | A1 | 8/2013 | Ma | |
| 2014/0041147 | A1* | 2/2014 | Pagoria et al. | 15/322 |

* cited by examiner

SURFACE CLEANING APPARATUS

FIELD

The invention relates generally to a surface cleaning apparatus. Specifically, an embodiment described herein relates to a steam mop for steam cleaning smooth floor surfaces, such as linoleum, wood and tile.

BACKGROUND

Throughout the world many homes include smooth flooring surfaces such as linoleum, vinyl, wood and ceramic tile and less carpeting and soft floor coverings. As such, there is an increased requirement for improved methods of cleaning such surfaces. Many steam cleaning appliances have been designed for floor cleaning but their shortcomings in terms of size, weight, reliability and cleaning performance have limited their use.

One problem associated with current steam mops is that steam alone may be insufficient to provide viable disinfection as the cleaning pad temperature adjacent to the surface being cleaned, and the surface being cleaned do not exceed 85° C. and that such temperatures are only maintained for short periods of time. Furthermore, many stains on a floor consist at least partially of organic materials which are therefore not readily dissolved or broken down by water and/or steam. There remains a need for a floor cleaning appliance which can effectively clean and disinfect hard floors, preferably while minimizing the use of harsh chemicals.

A further problem with the use of current steam mops is that many back and forth strokes are required to remove many types of stains.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

Surface cleaning apparatuses can be used to clean floors and other surfaces. In some embodiments, a surface cleaning apparatus can be configured to produce steam and/or heated water and to use the steam and/or heated water to help clean the surface. For example, a surface cleaning apparatus may be configured as a steam cleaning apparatus or steam mop that includes a reservoir for storing water, a heater or boiler for heating the water and converting at least a portion of the water into steam, and a surface cleaning member (such as a cleaning pad) for contacting the surface. The steam mop may include a nozzle for directing or spraying the steam and/or water directly onto the surface to be cleaned (for example in front of the surface cleaning member) so that the surface is pre-wetted before being contacted with the surface cleaning member. Alternatively, or in addition, a steam mop may be configured so that the steam and/or water is supplied to the surface clearing member, and/or sprayed through the surface cleaning member. In such a configuration, the surface cleaning member can be wetted and/or heated while it is in use, and can be the means by which the surface is wetted.

In accordance with one broad aspect of the teachings described herein, which may be used in combination with any other aspects described herein, a steam mop may optionally be configured to dispense a cleaning product or cleaning solution. For example, a steam mop may be configured to spray and/or dispense a floor cleaning solution onto the surface being cleaned, in addition to providing steam and/or water. Providing a cleaning solution may help improve the cleaning efficiency of the steam mop, and may optionally provide additional benefits, such as sanitizing or sterilizing the surface and providing pleasant fragrances or aromas. If provided in liquid form, the cleaning solutions may be delivered in the same manner as the steam and/or water. In some embodiments, the steam mop may include an on-board reservoir or tank to hold a quantity of the cleaning solution. Optionally, the cleaning solution may be contained in the same reservoir or tank that is used to hold the water for boiling. Preferably, a separate tank is provided to hold the cleaning solution separately from the water. Holding the cleaning solution separately may allow the cleaning solution to by-pass the boiler. This may be advantageous as boiling the cleaning solution, as opposed to only boiling the water, may lead to increased fouling of the boiler mechanism.

In accordance with this aspect, a cleaning mop may employ an environmentally friendly disinfectant in conjunction with a moist heated cloth and a source of steam. Accordingly, a reservoir may be adapted to feed an environmentally and health friendly cleaning and/or disinfecting solution optionally through or in proximity to a heating element, preferably by gravity but optionally by means of an electromechanical pump, at a predetermined rate which may be increased or decreased by the user in response to different flooring materials, stain types or quantities of stains, or different usage patterns including but not limited to a means to produce a "burst of cleaning" which may optionally be linked to a "burst of steam" previously described.

In accordance with another broad aspect of the teachings described herein, which may be used in combination with any other aspects described herein, the steam, water and/or cleaning solution (or any combination or sub-combination thereof) may be supplied to the surface cleaning member and/or sprayed onto the surface at any suitable delivery rate (i.e. flow rate). Optionally, the delivery rate may remain generally constant while the steam mop is in use. Alternatively, the delivery rate may be changed while the steam mop is in use, and preferably may be changed based on the operating condition of the steam mop. Accordingly, a reservoir may be adapted to feed water to the heating element, preferably by gravity but optionally by means of an electromechanical pump, at a predetermined rate which can be increased or decreased by the user in response to different flooring materials, stain types or quantities of stains, or different usage patterns including but not limited to a means to produce a "burst of steam." Different flooring surfaces and different usage patterns such as the number of cleaning strokes per minute may change the amount of steam and/or cleaning chemicals required to create optimal cleaning. An advantage of this embodiment is that the amount of steam and/or cleaning chemicals that is provided may vary based on the usage of the mop. For example, the delivery rate can be relatively low when the steam mop is being moved slowly and may be relatively higher when the steam mop is travelling more quickly over the surface being cleaned. The rate of speed of the steam mop may be directly sensed (for example using an optical sensor monitoring the surface or other suitable sensor) or may be estimated or approximated based on other features, such as, for example, the degree of inclination of the upper portion or handle of the steam mop (e.g. a larger inclination of the handle may be generally correlated with increased speed of the surface cleaning member) or the rate of change of the degree of inclination.

In accordance with another broad aspect of the teachings described herein, which may be used in combination with any other aspects described herein, the delivery rate may optionally be reduced to zero (i.e. no output) when the steam mop is moving very slowly and/or when the steam mop is in a storage position. Optionally, the steam mop may include a controller or control system that can automatically adjust the delivery rate based on the operating condition of the steam mop. The control system may include one or more sensors or transducers to sense or determine a state of the steam mop, and one or more actuators to modify or control the delivery rate of the steam, water and/or cleaning solution. Automatically adjusting the delivery rate may reduce the need for user intervention and may help ensure that an appropriate amount of water, steam and/or cleaning solution is supplied while the steam mop is in use.

In accordance with another broad aspect of the teachings described herein, which may be used in combination with any other aspects described herein, optionally, a controller or control system for a steam mop may also be configured to monitor a variety of operating conditions or parameters of the steam mop, including, for example, movement speed, reservoir or tank capacity or fill level, boiler temperature, water, steam and/or cleaning solution flow rate and handle position. The control system may include a variety of suitable transducers or sensors and may be operable to automatically perform given operations and/or control aspects of the steam mop based on the sensed operating conditions. For example, if the water reservoir is low or almost empty, the steam mop may alert a user that the tank is low and needs to be refilled. Alerting the user may be done using any suitable mechanism or transducer, including for example visual indicator such as a light or a display screen, an audible indicator such as a speaker, buzzer or siren, a tactile indicator such as a vibrating mechanism, or any other suitable feedback mechanism. For example, if the control system senses that the water tank is low, the control system may activate a light located in, or adjacent, the water tank to draw a user's attention.

In accordance with another broad aspect of the teachings described herein, which may be used in combination with any other aspects described herein, the surface cleaning apparatus may optionally include a moveable surface cleaning member. For example, the surface cleaning member on a steam mop (e.g. the surface cleaning pad) may be translated or vibrated in a plane that is parallel to the surface being cleaned (e.g. the horizontal plane), relative to the rest of the steam mop. The steam mop may include any suitable actuator, such as an electric motor, to drive the movements of the surface cleaning member, and may also include any suitable energy supply or energy storage apparatus (e.g. a cord to plug into a wall socket and/or an onboard battery or other mechanism). Moving the surface cleaning member in a plane generally parallel to the floor may help produce a scrubbing action that may help remove debris from the surface being cleaned. The surface cleaning member may be moved in a forward-backward direction (relative to the direction of the movement of the steam mop), the side-to-side direction, in a rotary or orbital motion, any other suitable path or range of motion, and any combination or sub-combination thereof.

In accordance with another aspect of the teachings described herein, which may be used in combination with any other aspect, a surface cleaning apparatus may include a surface cleaning head including a cleaning pad mount that is configured to receive a cleaning pad. A steam distribution system may be provided and may include a steam unit in fluid communication with a water reservoir and may have a steam outlet in communication with the cleaning pad mount. A cleaning solution distribution system may be provided and may include a cleaning solution reservoir in communication with a dispensing outlet.

The cleaning solution may include quaternary ammonium compounds, colloidal silver, thyme oil, cinnamon oil, rosemary oil, sage oil, acetic acid, hydrogen peroxide, tea tree oil, or a combination thereof.

The dispensing outlet may be configured to provide the cleaning solution to a cleaning pad on the cleaning pad mount. Alternately, the outlet may provide the fluid to a fluid distribution system of the cleaning ad mount so as to distribute the fluid evenly across a pad attached to the mount.

Preferably, an absorbent cloth is provided over the bottom of a floor nozzle assembly to make contact with the floor surface. A relatively stiff perimeter frame may be attached to the cloth to form a cloth assembly that is adapted to fit snugly around the bottom perimeter of the housing, to secure the cloth to the steam mop.

The cloth assembly may be easily fitted to the housing by lifting the mop a few inches off the floor, sliding the cloth assembly underneath the mop, and setting the housing of the mop down inside the perimeter frame.

The surface cleaning apparatus may include a detector that receives a signal indicative of the usage of a cleaning pad provided on the cleaning pad mount and a controller configured to adjust the amount of at least one of steam and cleaning solution delivered based on a signal from the detector.

The detector may include at least one of a detector to determine the inclination of a handle of the surface cleaning apparatus, the rate of change of the inclination of the handle, the velocity of the surface cleaning head, the rate of acceleration of the surface cleaning head and the conductivity of a cleaning pad.

A manually controllable actuator may be connected to at least one of the steam distribution system and the cleaning solution distribution system.

An automatic dispensing system may be connected to at least one of the steam distribution system and the cleaning solution distribution system and a manually controllable dispensing system may be connected to at least one of the steam distribution system and the cleaning solution distribution system.

The automatic dispensing system and the manually controllable dispensing system may each be operatively connected to the same distribution system.

The dispensing outlet may include at least one nozzle directed downwardly at a location that is forward of the cleaning pad mount.

The cleaning pad mount may be moveably mounted to the surface cleaning head and the surface cleaning head may include a drive unit drivingly connected to the cleaning pad mount.

The drive unit may be drivingly connected to the cleaning pad mount to move the cleaning pad mount in a plane that is essentially parallel to a surface to be cleaned.

The drive unit may include at least one motor and at least one offset weight.

The drive unit may include at least one of a solenoid, a sonic transducer, an ultrasonic transducer and a loudspeaker.

At least one of the water reservoir, the cleaning solution reservoir and a steam boiler, and preferably all, may be provided in the surface cleaning head.

The surface cleaning head may have a height less than about 4 inches.

At least a portion, and preferably all, of one, and preferably both, of the water reservoir and the cleaning solution reservoir may be transparent.

The steam distribution system may be configured to deliver steam and heated water.

The surface cleaning apparatus may include at least one light (e.g., a LED) to illuminate the water reservoir, to illuminate the cleaning solution reservoir or to illuminate an area in front of the surface cleaning head, and preferably all of those.

The surface cleaning apparatus may include at least one light to illuminate the water reservoir and/or the cleaning solution reservoir and a control system to vary the illumination when the one of the water reservoir and the cleaning solution reservoir reaches a low fluid level.

The steam distribution system may include a boiler and the surface cleaning apparatus may include a low water level detection circuit. The low water level detection circuit may include a detector monitoring the work performed by the boiler and a signal member providing a signal when the level of work performed by the boiler drops below a threshold limit.

The detector may monitor the temperature of the boiler.

The surface cleaning apparatus may include a cleaning pad. The cleaning pad may include a hydrophobic material and/or and a hydrophilic material.

According to another aspect of the teachings described herein that may be used in combination with any other aspect, a surface cleaning apparatus may include a surface cleaning head including a cleaning pad mount that is configured to receive a water absorbent cleaning pad. A fluid distribution system may be communication with the cleaning pad mount. An automatic dispensing system may be operatively connected to the fluid distribution system. A detector may receive a signal indicative of the usage of a cleaning pad provided on the cleaning pad mount and a controller may be configured to adjust the amount of at least one of steam and cleaning solution delivered based on a signal from the detector.

The detector may include at least one of a detector to determine the inclination of a handle of the surface cleaning apparatus, the rate of change of the inclination of the handle, the velocity of the surface cleaning head, the rate of acceleration of the surface cleaning head and the conductivity of a cleaning pad.

The surface cleaning apparatus may include a manually controllable actuator operatively connected to at least one of the fluid distribution system.

The fluid distribution system may include a steam distribution system including a steam unit in fluid communication with a water reservoir and having a steam outlet in communication with the cleaning pad mount and a cleaning solution distribution system including a cleaning solution reservoir in communication with a dispensing outlet. The automatic dispensing system may be operatively connected to at least one of the steam distribution system and the cleaning solution distribution system and a manually controllable dispensing system may be operatively connected to at least one of the steam distribution system and the cleaning solution distribution system.

The automatic dispensing system and the manually controllable dispensing system may each be operatively connected to the same distribution system.

The water reservoir may be provided in the surface cleaning head.

The surface cleaning head may have a height less than about 4 inches.

The at least a portion of the water reservoir may be transparent.

The fluid distribution system may be configured to deliver steam and heated water.

The fluid distribution system may include a steam outlet and a heated water outlet.

The automatic dispensing system may control output from at least one of the steam outlet and the heated water outlet.

The automatic dispensing system may control output from both of the steam outlet and the heated water outlet.

The surface cleaning apparatus may include a manual dispensing system and the automatic dispensing system may control output from at least one of the steam outlet and the heated water outlet and the manual dispensing system may control output from at least one of the steam outlet and the heated water outlet.

The surface cleaning apparatus may include a manual dispensing system and the automatic dispensing system may control output from one of the steam outlet and the heated water outlet and the manual dispensing system may control output from the other of the steam outlet and the heated water outlet.

At least one light may be provided to illuminate the water reservoir or to illuminate an area in front of the surface cleaning head.

At least one light may be provided to illuminate the water reservoir and a control system may vary the illumination when the water reservoir reaches a low fluid level.

The steam distribution system may include a boiler and the surface cleaning apparatus may include a low water level detection circuit. The low water level detection circuit may include a detector monitoring the work performed by the boiler and a signal member providing a signal when the level of work performed by the boiler drops below a threshold limit.

The detector may monitor the temperature of the boiler.

It will be appreciated by a person skilled in the art that a mop may embody any one or more of the features contained herein and that the features may be used in any particular combination or sub-combination.

DRAWINGS

The drawings included herewith are for illustrating various examples of articles, methods, and apparatuses of the teaching of the present specification and are not intended to limit the scope of what is taught in any way.

DETAILED DESCRIPTION

Figure 1:
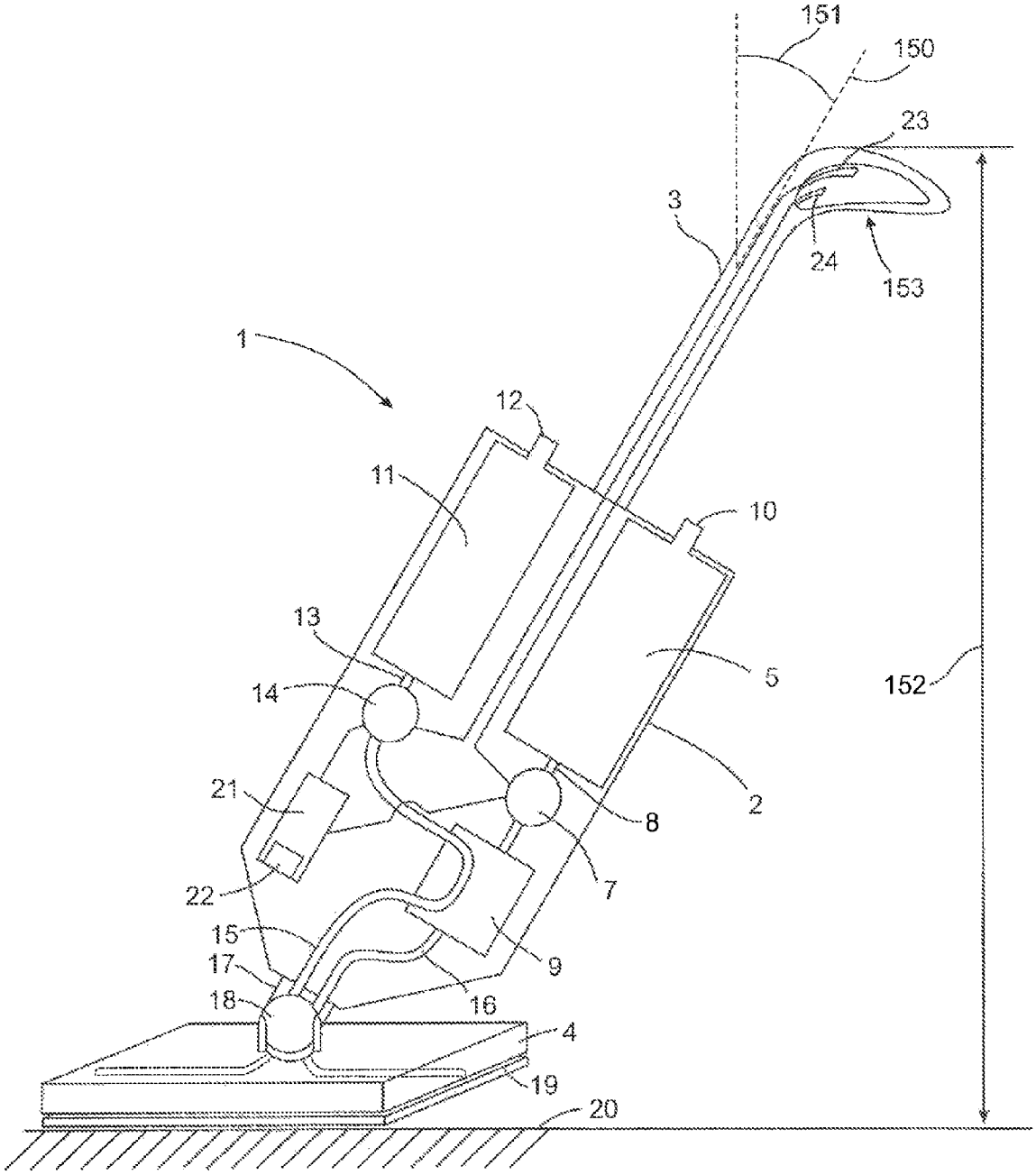
FIG. 1 is a schematic representation of one embodiment of a steam mop.

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Surface cleaning apparatuses can be used to clean floors and other surfaces. In some embodiments, a surface cleaning apparatus can be configured to produce steam and/or heated water and to use the steam and/or heated water to help clean the surface. For example, a surface cleaning apparatus may be configured as a steam cleaning apparatus or steam mop that includes a reservoir for storing water, a heater or boiler for heating the water and converting at least a portion of the water into steam, and a surface cleaning member (such as a cleaning pad) for contacting the surface. The steam mop may include a nozzle for directing or spraying the steam and/or water directly onto the surface to be cleaned (for example in front of and/or behind the surface cleaning member) so that the surface is pre-wetted before being contacted with the surface cleaning member. Alternatively, or in addition, a steam mop may be configured so that the steam and/or water is supplied to the surface cleaning member, and/or sprayed through the surface cleaning member. In such a configuration, the surface cleaning member can be wetted and/or heated while it is in use, and can be the means by which the surface is wetted. Any of these embodiments may be used individually in a steam cleaning apparatus or they may be used in any combination or subcombination and may be used with any one or more of the aspects set out herein.

In accordance with one broad aspect of the teachings described herein, which may be used in combination with any other aspects described herein or any one of the forgoing embodiments, a steam mop may optionally be configured to dispense a cleaning product or cleaning solution. For example, a steam mop may be configured to spray and/or dispense a floor cleaning solution onto the surface being cleaned, in addition to providing steam and/or water. Providing a cleaning solution may help improve the cleaning efficiency of the steam mop, and may optionally provide additional benefits, such as sanitizing or sterilizing the surface and providing pleasant fragrances or aromas. If provided in liquid form, the cleaning solutions may be delivered in the same manner as the steam and/or water. In some embodiments, the steam mop may include an on-board reservoir or tank to hold a quantity of the cleaning solution. Optionally, the cleaning solution may be contained in the same reservoir or tank that is used to hold the water for boiling. Preferably, a separate tank can be provided to hold the cleaning solution separately from the water. Holding the cleaning solution separately may allow the cleaning solution to by-pass the boiler. This may be advantageous as boiling the cleaning solution, as opposed to only boiling the water, may lead to increased fouling of the boiler mechanism.

In accordance with another broad aspect of the teachings described herein, which may be used in combination with any other aspects described herein or any one of the forgoing embodiments, the steam, water and/or cleaning solution (or any combination or sub-combination thereof) may be supplied to the surface cleaning member and/or sprayed onto the surface at any suitable delivery rate (i.e. flow rate). Optionally, the delivery rate may remain generally constant while the steam mop is in use. Alternatively, the delivery rate may be changed while the steam mop is in use, and preferably may be changed based on the operating condition or extent of use of the steam mop. For example, the delivery rate can be relatively low when the steam mop is being moved slowly and may be relatively higher when the steam mop is travelling more quickly over the surface being cleaned. The rate of speed of the steam mop may be directly sensed (for example using an optical sensor monitoring the surface or other suitable sensor) or may be estimated or approximated based on other features, such as, for example, the degree of inclination of the upper portion or handle of the steam mop (e.g. a larger inclination of the handle may be generally correlated with increased speed of the surface cleaning member) or the rate of change of the inclination of the handle.

In accordance with another broad aspect of the teachings described herein, which may be used in combination with any other aspects described herein or any one of the forgoing embodiments, the delivery rate may optionally be reduced to zero (i.e. no output) when the steam mop is moving very slowly and/or when the steam mop is in a storage position. Optionally, the steam mop may include a controller or control system that can automatically adjust the delivery rate based on the operating condition of the steam mop. The control system may include one or more sensors or transducers to sense or determine a state of the steam mop, and one or more actuators to modify or control the delivery rate of the steam, water and/or cleaning solution. Automatically adjusting the delivery rate may reduce the need for user intervention and may help ensure that an appropriate amount of water, steam and/or cleaning solution is supplied while the steam mop is in use.

In accordance with another broad aspect of the teachings described herein, which may be used in combination with any other aspects described herein or any one of the forgoing embodiments, optionally, a controller or control system for a steam mop may also be configured to monitor a variety of operating conditions or parameters of the steam mop, including, for example, movement speed, reservoir or tank capacity or fill level, boiler temperature, water, steam and/or cleaning solution flow rate and handle position. The control system may include a variety of suitable transducers and may be operable to automatically perform given operations and/or control aspects of the steam mop based on the sensed operating conditions. For example, if the water reservoir is low or almost empty, the steam mop may alert a user that the tank is low and needs to be refilled. Alerting the user may be done using any suitable mechanism or transducer, including for example visual indicator such as a light or a display screen, an audible indicator such as a speaker, buzzer or siren, a tactile indicator such as a vibrating mechanism, or any other suitable feedback mechanism. For example, if the control system senses that the water tank is low, the control system may activate a light located in, or adjacent, the water tank to draw a user's attention.

In accordance with another broad aspect of the teachings described herein, which may be used in combination with any other aspects described herein or any one of the forgoing embodiments, the surface cleaning apparatus may optionally include a moveable surface cleaning member. For example, the surface cleaning member on a steam mop (e.g. the surface cleaning pad) may be translated or vibrated in a plane that is generally parallel to the surface being cleaned (e.g. the horizontal plane), relative to the rest of the steam mop. The steam mop may include any suitable actuator, such as an electric motor, to drive the movements of the surface cleaning member, and may also include any suitable energy supply or energy storage apparatus (e.g. a cord to plug into a wall socket and/or an onboard battery or other mechanism). Moving the surface cleaning member in the lateral direction may help produce a scrubbing action that may help remove debris from the surface being cleaned. The surface cleaning member may be moved in a forward-backward direction (relative to the direction of the movement of the steam mop), the side-to-side direction, in a rotary or orbital motion, any other suitable path or range of motion, and any combination or sub-combination thereof.

In accordance with one embodiment of a surface cleaning apparatus, the surface cleaning apparatus may be configured as a steam mop that includes an upper portion that is pivotally and drivingly connected to a surface cleaning head. Referring to FIG. 1, a steam mop 1 is shown. In the illustrated embodiment, the upper portion is provided in the form of a housing 2 and a handle 3 extending upwardly from the housing 2. The upper portion generally extends along an upper axis 150. The housing 2 is pivotally coupled to a surface cleaning head in the form of floor nozzle or surface cleaning head 4. The housing 2 may be pivotable between a storage position (in which it is positioned generally above the floor nozzle 4) and a use position (FIG. 1) in which the upper axis 2*a* is inclined at an angle 151 relative to a vertical plane. The pivot connection between the housing 2 and floor nozzle 4 can be provided by any suitable mechanism, including, for example a pin joint.

The handle 3 extends generally upwardly from the housing. The length of the handle, and resulting overall height of the steam mop 1, may be any suitable length and preferably is provided to be long enough to permit a user of the steam mop 1 to maneuver the floor nozzle 4 on a floor surface 20 which it is desired to clean from a standing position. For example, the combined length of the handle 3 and housing 2 may be selected so that when the steam mop 1 is in use (as illustrated in FIG. 1) the hand grip portion 153 of the handle 3 is spaced above the surface 20 by an operating height 152 that may be between about 36 inches and about 48 inches or more, and preferably may be between about 40 and about 48 inches. Optionally, the floor nozzle 4 can have a height that is between about 1 inch and about 8 inches, and may be between 2 inches and 6 inches and may be less than about 4 inches. Providing a relatively short floor nozzle 4 may allow the nozzle 4 to fit beneath furniture or other obstacles.

The housing 2 may be configured to house or at least partially contain one or more fluid tanks or reservoirs and optionally may contain one or more boilers, heaters, heat exchangers and other steam producing elements. While illustrated schematically in FIG. 1, the housing 2 may be of any suitable shape, size and configuration and may be made from any suitable materials, including, for example, metal and/or plastic.

In the illustrated embodiment, the housing 2 contains steam producing elements or steam distribution system which may be any combination of elements to convey water from a storage tank and deliver steam to an output. As exemplified, the steam distribution system comprises a water reservoir 5 from which water passes through tube member 6 into an electromechanical fluid pump or electromechanical fluid valve 7 through tube member 8 and into a water boiler 9. The reservoir 5 may be of any suitable configuration, and may be formed from any suitable material, including, for example metal, plastic and glass. Optionally, the reservoir 5 may be removable from the housing 2. Providing a removable reservoir 5 may allow a user to separate the reservoir from the housing 2 to fill, empty, clean or otherwise handle or manipulate the reservoir 5. If the reservoir 5 is removable, preferably a valve or other flow limiting device can be provided at the interface between reservoir 5 and tube 8 (or anywhere else in the flow path) to prevent water from leaking out of the reservoir when it is detached. An inlet port 10 may be provided toward the top of reservoir 5 for filling the reservoir 5 with water.

The electromechanical fluid valve 7 may be any suitable valve and may be configured to supply water to the boiler 9 at a prescribed delivery rate. Optionally, the electromechanical fluid valve 7 may be controlled by any suitable controller (for example microprocessor 21) and may be operable to supply water to the boiler 9 at a variety of different delivery rates. Alternatively, the water from water reservoir 5 may be dispensed into the water boiler 9 at a substantially steady rate under the influence of gravity or by other means as known in the art, without the need for a separate flow regulating or pressurizing means, such as electromechanical fluid valve 7.

In the illustrated embodiment the water reservoir 5 is not provided with an internal heating element as is done in some other steam generating systems in steam mops in the art. Instead, in the illustrated embodiment, the heating means for heating the water is provided in the form of an external boiler unit 9 that is provided within the housing 2 but is separate from and outside the reservoir 5. The boiler unit 9 may include an electric heating element or heating plate, or any other suitable heating mechanism. In this configuration, the reservoir 5 is not directly heated by the boiler unit 9. Instead, only the volume of water that is dispensed from the reservoir 5, for example via electromechanical fluid valve 7, is heated by the boiler unit 9. As the volume of water dispensed from the reservoir is generally smaller than the volume of water held in reservoir 5 (except when the reservoir 5 is nearly empty), the boiler unit 9 need only heat a relatively small volume of water and is therefore able to bring this water to high temperature relatively quickly as compared to the time required to heat the entire standing volume of the reservoir 5. One advantage of this strategy may be the fact that controlling of the delivery rate water from the reservoir 5 to the water boiler 9 may provide substantially direct and relatively immediate control of the amount of steam produced by the boiler 9. This may allow a user to selectably generate more or less steam on demand by varying the flow rate of electromechanical fluid valve 7. The flow rate may also be selected so that a mixture of heated water and steam is provided downstream from the boiler 9. In this configuration, heated water, steam or a combination of both may be dispensed onto the cleaning pad 19 or directly onto the surface 20.

Optionally, cleaning solution may be mixed with the water in reservoir 5. Alternatively, the steam mop 1 may include a separate cleaning fluid reservoir. Providing a separate cleaning fluid reservoir may eliminate the need to boil the cleaning fluid in the boiler 9 before it reaches the surface 20.

In the illustrated embodiment, the steam mop 1 includes a separate cleaning fluid reservoir 11 within the housing 2. The cleaning fluid reservoir 11 is part of a cleaning fluid distribution system and may be the same as water reservoir 5, and may include some or all of the same features. Alternatively, the cleaning fluid reservoir 11 may be configured differently than the water reservoir 5. Referring to FIG. 1, in the illustrated embodiment the cleaning fluid reservoir 11 is filled by means of port 12. The cleaning fluid reservoir 11 may be filled with any suitable cleaning solution, including soaps, detergents, natural cleaning products, disinfectants and other suitable chemicals. Optionally, the cleaning fluid used may be an environmentally friendly cleaning and disinfecting agent which is not readily denatured by the application of heat, steam, moisture or a combination thereof. Examples of such environmentally friendly cleaning and disinfecting agents may include, for example, quaternary ammonium compounds, colloidal silver, thyme oil, cinnamon oil, rosemary oil, sage oil, acetic acid, hydrogen peroxide, tea tree oil, or a combination thereof.

In the illustrated embodiment, the cleaning fluid passes from the cleaning fluid reservoir 11 through tube member 13 and into the electromechanical fluid pump or electromechanical fluid valve 14 then through tube member 15 which may optionally pass in proximity to the water boiler 9 as a means of heating the cleaning fluid to enhance its efficacy. Preferably, the cleaning fluids may be heated to above room temperature and may be heated to between about 70° C. to 99° C. or more, and may be heated to between about 75 to 95° C. and preferably to between about 80 to 90° C.

In the illustrated embodiment, once the water has been boiled within the boiler 9, the generated steam from the boiler 9 passes through tube member 16 to a support member 17 that forms part of universally rotatable joint 18 that connects the housing 2 to the floor nozzle 4. Tube member 15 carrying the cleaning solution may also be routed to the support member 17. A surface cleaning member, in the form of a cleaning pad 19 is affixed to a cleaning pad mount provided on the underside of the floor nozzle 4 by means known in the art. Preferably, the cleaning pad 19 is removably coupled to the nozzle 4 (e.g. by hook and loop fasteners or other suitable connectors) so that it can be detached for cleaning and/or can be replaced when worn.

The handle may be drivingly connected to nozzle 4 by any means known in the art. The cleaning pad mount may be any cleaning pad mount known in the art.

The cleaning pad 19 may be any suitable type of mop pad or cleaning pad, including, for example a cloth or fabric pad, a sponge, a microfiber pad, a foam or other type of pad member. Optionally, the pad 19 may be formed from natural or synthetic fibres, or a combination thereof. In some embodiments, the cleaning pad 19 may be selected to be made from hydrophobic and/or hydrophilic material and/or may be treated to provide a desired level of hydrophobicity or hydrophilicity. The cleaning pad 19 may be of any suitable shape, including, for example rectangular, triangular, round, curved or any other shape. The cleaning pad 19 may be of any suitable size. In the illustrated embodiment, the pad 19 is generally rectangular and may be about 5.5 inches by about 10.5 inches.

The flow of cleaning fluid through valve 14 can be controlled by any suitable controller, like the flow of water described above. In the illustrated example, the microprocessor 21 which controls the water electromechanical fluid valve 7 also controls valve 14. Alternatively, a different controller may be used.

As with valve 7, the valve 14 can be operated to dispense the cleaning fluid at a fixed rate throughout the operation of steam mop 1. Alternatively, the valve 14 (and optionally valve 7) can be operated to adjust the delivery rate of the cleaning based on the inclination of the steam mop (e.g. the magnitude of angle 151) or the rate of change of the inclination of the handle. The inclination angle 151 of the steam mop 1 can be between about 5 degrees to about 90 degrees from the vertical, and may be between about 15 to about 60 degrees from the vertical, and most typically may be between about 20 to about 50 degrees from the vertical. For example, the microprocessor 21 may be configured to control the valve 7, 14 to increase the delivery rate of the cleaning solution when the angle 151 increases. The increases in the rate of delivery of the cleaning solution (and/or steam or water) may be continuously variable and/or proportional to the angle 151. Alternatively, the valve 7, 14 may be positionable in two or more discrete positions so that the delivery rate changes as a step function (between predetermined flow rates) instead of in a continuous manner.

To determine the angle 151 of the upper portion, the steam mop 1 may include any suitable type of sensor, detector or transducer, including, for example, an accelerometer, an encoder or microswitch in pivot joint 18, an optical sensor or any other suitable mechanism that can be connected to the microprocessor 21 that controls an automatic dispensing system. In the illustrated embodiment accelerometer 22 is provided in the housing 2, in communication with microprocessor 21, and can be used to determine the inclination of the upper portion.

Alternatively, or in addition, the microprocessor 21 can dispense fluid at a delivery rate that is proportional to, or based on, the rate of back and forth motion of the steam mop 1, which can be electronically sensed by any suitable sensor, including, for example, accelerometer 22.

Alternately, or in addition, microprocessor 21 can be configured to control the dispensing of a fluid based on the conductivity of the cleaning pad. For example, optionally, the steam mop 1 may include a sensor for monitoring the conductivity or resistivity of the cleaning pad 19. The conductivity and/or resistivity of the cleaning pad 19 may vary with its moisture level or fluid saturation. The sensor can be connected to the microprocessor 21, which can be configured to dispense steam, water or cleaning solution if the conductivity falls outside or within a predetermine range. This may allow the steam mop 1 to automatically dispense additional steam, water of cleaning solution when the pad 19 becomes relatively dry, and/or limit dispensing of fluid when the pad 19 is relatively wet.

Optionally, a manually triggered dispensing system may include a trigger mechanism 23 that is provided to enable the user to selectably dispense additional cleaning fluid in order to deal with specific stains or other cleaning issues. Alternatively, or in addition to trigger mechanism 23, a steam trigger mechanism 24 may be provided to enable the user to selectably dispense additional steam in order to deal with specific stains or other cleaning issues. The triggers 23 and 24 may be any suitable mechanical or electromechanical fluid dispensing mechanisms. While illustrated as separate triggers 23 and 24, instead of, or in addition to separate trigger 23 and 24, the steam mop 1 may include a trigger mechanism that is configured to simultaneously dispense both cleaning solution and steam.

The water or steam and/or cleaning solution may be delivered to the cleaning pad 19 or directly to surface 20. In the illustrated embodiment, the fluids drip from tubes 15 and 16, through pivot joint 18 and onto the pad 19. For the illustrated cleaning pad, which is about 5.5 inches×10.5 inches, a cleaning solution flow rate may be between about 1 to and about 30 ml per minute, and may be between about 3 to 15 ml per minute or between about 6 to 12 ml per minute.

Figure 2:
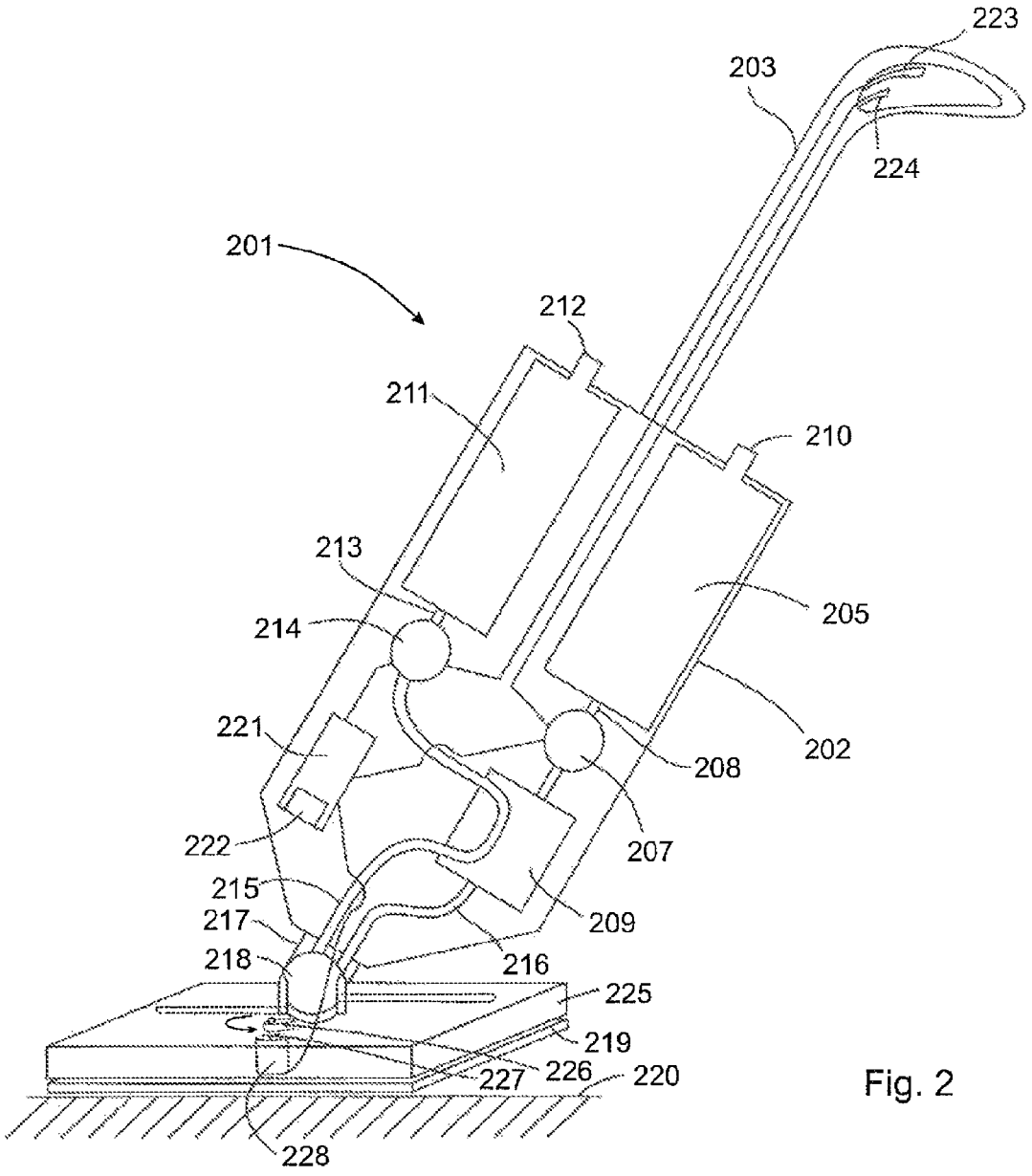
FIG. 2 is a schematic representation an alternative embodiment of a steam mop.

Referring to FIG. 2, an alternative embodiment of a steam mop 201 is shown. Steam mop 201 is generally similar to steam mop 1, and analogous elements are identified using like reference characters indexed by 200. In this example an alternative embodiment of a floor nozzle 225 is shown. The nozzle 225 may be generally similar to nozzle 4. An electromechanical means is provided to induce short stroke mechanical motion of an alternative nozzle 225 and mount supporting the cleaning pad 219 in a horizontal or lateral plane that is, preferably, generally parallel to the floor 220. The mechanism for creating planar motion of the nozzle 225 and mount for the pad 219 thereon may be any suitable mechanism or drive unit, including, for example an electric motor. The mechanism may be selectably controlled via the microprocessor 221, may be controlled by a user or may be "always on" when the steam mop 201 is powered. Power may be supplied by an external source, or an on board source. Alternatively, instead of an electromechanical mechanism, a non-electric mechanism, such as a spring, movable weight, etc. may be used to impart motion to the pad 219.

The short stroke motion distance may by any suitable distance, and in some embodiments may be between about 0.001 inches to about 2.000 inches, more about 0.005 to about 1.000 inches, and preferably may be between about 0.010 to about 0.250 inches and between about 0.025 to about 0.100 inches.

In the embodiment of FIG. 2, the mechanism for creating the motion includes a motor 228 with an offset weight 226 mounted to the motor shaft 227. The motor 228 is energized when the steam mop is turned on, or more preferably when the steam mop 201 is in the working inclination angle. When the motor 228 is energized, the offset weight 227 can rotate around shaft 227 which may cause an oscillatory motion of the steam mop nozzle 225 and/or the cleaning pad 219. Inducing motion in the nozzle 225 or pad 219 may help enhance the cleaning performance of the steam mop. Optionally, more than one motor with an offset weight attached may be used and they may operate at different rotational speeds to create a more complex oscillatory motion.

Figure 3:
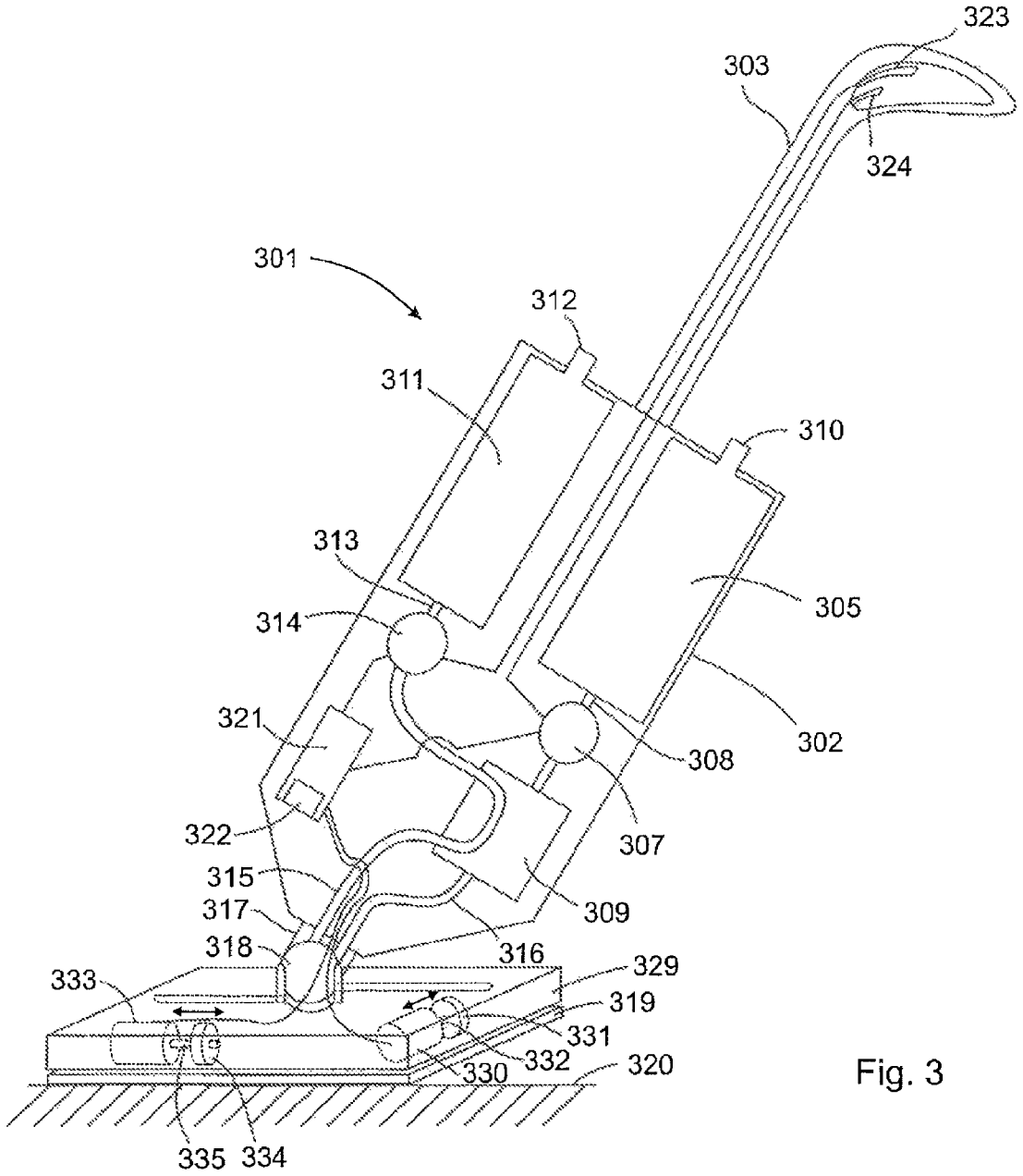
FIG. 3 is a schematic representation of a further alternative embodiment of a steam mop.

Instead of a rotary type mechanism, the surface nozzle may include one or more linear-type movement inducing mechanism. Referring to FIG. 3, an alternative embodiment of a steam mop 301 is shown. Steam mop 301 is generally similar to steam mop 1, and analogous elements are identified using like reference characters indexed by 300. an alternative embodiment of a surface nozzle 329 is shown. The nozzle 329 includes linear electromechanical means to induce short stroke mechanical motion of an alternative nozzle 329 and cleaning pad 319 in one or more axis essentially parallel to the floor 320. In FIG. 3, a solenoid 330 is mounted within nozzle 329 and has a weight 331 attached to its moving member 332. In this configuration, when the solenoid is energized, for example with an AC waveform signal, a linear oscillation is created (as illustrated by arrows adjacent the solenoid 330). The solenoid 330 may induce motion in substantially one linear direction.

Optionally, a second solenoid 333 can be mounted within the nozzle 329. The solenoid 333 has a weight 334 attached to its moving member 335. When the solenoid is energized with an AC waveform signal, a linear oscillation in a second, different linear direction may be created. The AC signal applied to the second solenoid 333 may include the same features as the AC signal applied to the first solenoid 330, or may be different.

The frequency of the AC signal applied to either or both solenoids 330, 333 may be varied either periodically or continuously to enhance the mechanical action. The range of applied frequencies for the solenoids 330, 333 can be any suitable range, including, for example from about 0.01 Hz to about 60 KHz, from about 1 Hz to about 20 KHz and preferably from about 10 Hz to about 30 Hz. Optionally, more than 2 solenoids may be employed.

Alternatively, or in addition any type of actuator may be used in combination with any of the embodiments herein to impart the desired vibration, including, for example a linear motor, a miniature acoustic or ultrasonic transducer, and a loudspeaker may be used in place of the solenoid to create the mechanical motion described. The actuator may be manually controlled by a user, have different speeds or it may operate automatically when the handle is in a use position.

Figure 4:
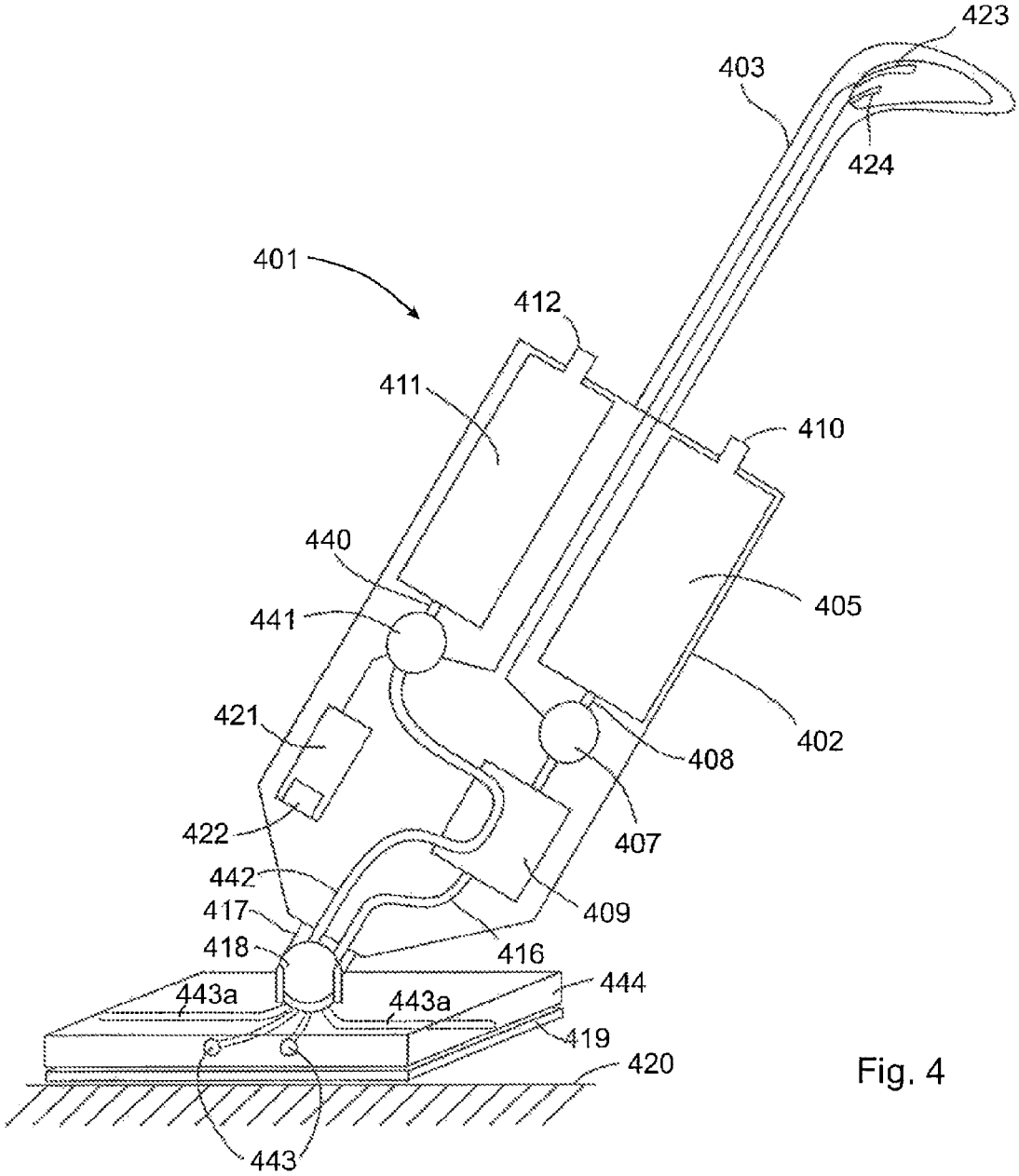
FIG. 4 is a schematic representation of a further alternative embodiment of a steam mop according.

Referring to FIG. 4, an alternative embodiment of a steam mop 401 is shown. Steam mop 401 is generally similar to steam mop 1, and analogous elements are identified using like reference characters indexed by 400. According to the present invention is shown wherein cleaning fluid passes from the cleaning fluid reservoir 411 through tube member 440 and into the pump 441 then through tube member 442 which may optionally pass in proximity to the water boiler 409 as a means of heating the cleaning fluid to enhance its efficacy. The tube member 442 then passes along or through the support member 417 and to one or more spray nozzles 443 positioned along the front edge of the floor nozzle 404 to enable the cleaning fluid to be sprayed onto the surface to be cleaned.

The spray nozzles 443 may be any suitable fluid dispensing apparatus, and may be configured to eject the fluid as a mist, a stream or in any other suitable mode. Similarly, the nozzles 443 may be configured to dispense steam, heater water (water that has passed through boiler 409 but not converted to steam) and/or cleaning solution. Separate nozzles 443 may be provided for the steam and the cleaning solution. Alternatively, the steam and cleaning solution may be mixed upstream from the nozzles 443, so that a mixture is sprayed from the nozzles 443. In configurations where the steam and cleaning solution are mixed upstream from the nozzles 443 (for example within the support member 417), multiple nozzles 443 may still be provided for a variety of reasons, including, for example to help provide a wider spray pattern and to help provide a desired fluid flow rate. Optionally, one of the nozzles 443 may be configured to deliver a combination of both steam and heated water (or just steam, or just heated water) while another other nozzle 443 is configured to deliver the cleaning solution.

The cleaning spray from the spray nozzles 443 may occur under a variety of different conditions, including, for example the spray may be generally continuous when the steam mop 401 is turned on, or the spray may be produced only when steam mop 401 is in the working inclination angle and/or in response to back and forth motion which is electronically or mechanically sensed (for example using microprocessor 421), or any combination thereof.

It is understood that the spray means of dispensing the cleaning fluid as shown in FIG. 4 may be used in conjunction with the means of dispensing the cleaning fluid shown in FIG. 1 For example, additional supply conduits 443*a* may be provided within the floor nozzle 444 to apply steam and/or cleaning solution to the pad 419, independently from the supply of fluids to the nozzles 443.

Figure 5:
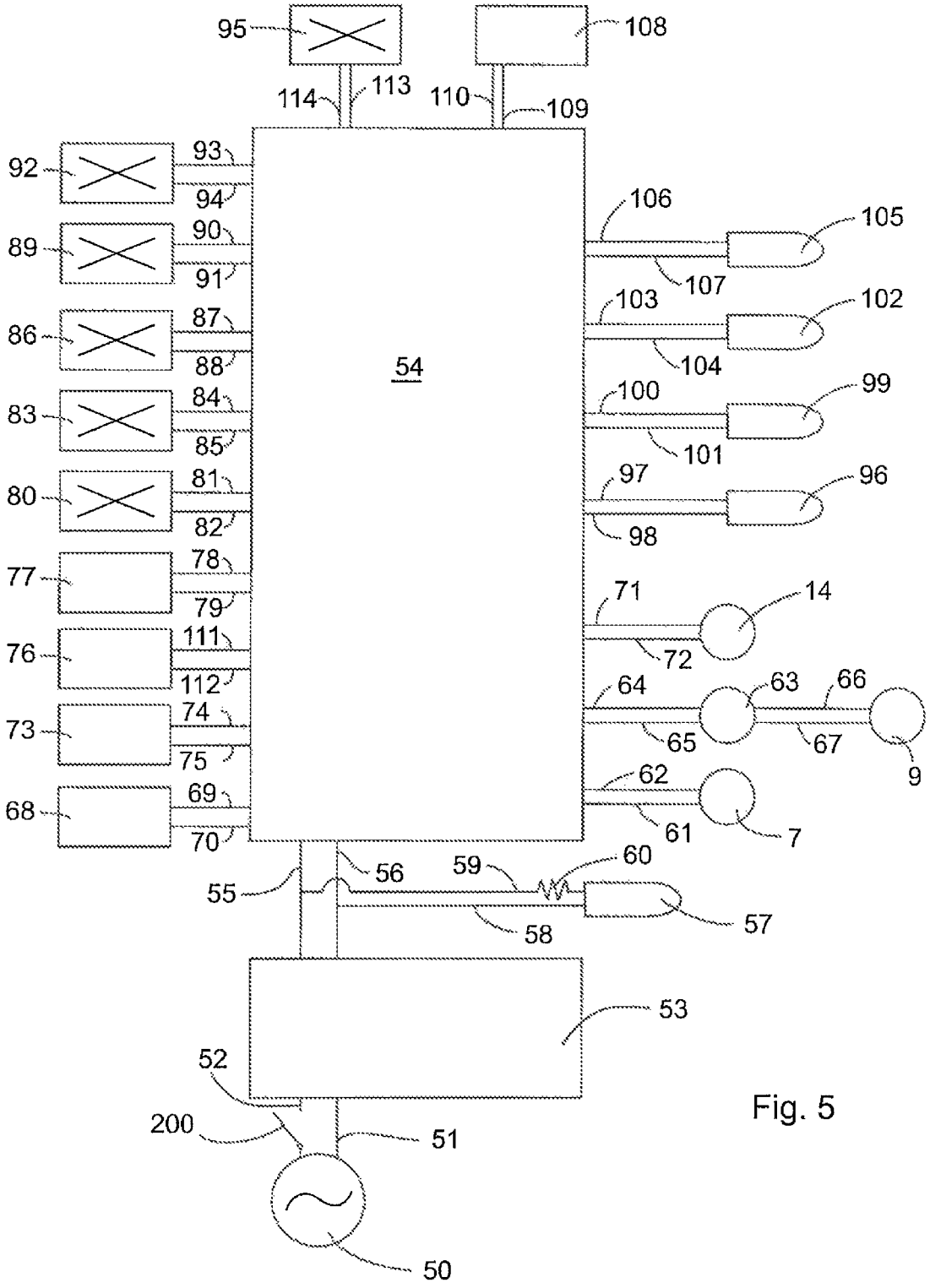
FIG. 5 is a block diagram of one embodiment of control electronics for a steam mop.

Referring to FIG. 5, a schematic representation of one embodiment of a control system for controlling a steam mop is shown. The control system includes a power source 50. The power source 50 may be any suitable source, including, for example, an alternating current source or a DC battery.

In the illustrated embodiment, wires 51 and 52 lead are connected to a power supply 53, which in turn provides power to a microcontroller 54 via wires 55 and 56. The microcontroller 54 may be any suitable microcontroller or other controller apparatus, including, for example, the microcontrollers positioned within the housings of the embodiments of the steam mops described herein. The microcontroller 54 is configured to receive signals from a plurality of sensors and/or transducers, and is operable to control a variety of output devices, including, for example user feedback and/or information display apparatuses.

In the illustrated embodiment, LED light 57 is connected to wires 55 and 56 by means of wires 58 and 59 which may optionally incorporate resistor 60 if the voltage required by the microcontroller 54 does not match the voltage required by the LED light 57. The LED 57 may be used to indicate to the user that power is being supplied to the appliance. LED 57 may optionally by controlled and or powered by the microcontroller 54 directly.

An electromechanical valve an electromechanical fluid pump or electromechanical fluid valve 7 (see also FIG. 1) is connected to microcontroller 54 by means of wires 61 and 62 and provides the means to control the flow of water from the water reservoir 5 to the water boiler 9 thereby controlling the rate of steam generation.

Optionally, a power relay or field effect transistor 63 may be connected to the microcontroller 54 by means of wires 64 and 65. This may provide a means of turning on and off the power to the water boiler 9 (FIG. 1) through wires 66 and 67. The power to the water boiler 9 can be controlled using any suitable criteria, including, for example, being turned on and off based on an algorithm to maintain a specified temperature range as measured by a water boiler temperature sensor 68 which is connected to the microcontroller 54 by means of wires 69 and 70.

Optionally, a thermo-mechanical relay device may be used to directly control the power to the water boiler 9 in response to the temperature of the boiler. One advantage of a microcontroller based control system may be that the temperature hysteresis exhibited by some typical thermo-mechanical devices may be avoided and more precise control may be achieved.

In the illustrated embodiment, an electromechanical valve an electromechanical fluid pump or electromechanical fluid valve 14 (FIG. 1) is connected to microcontroller 54 by means of wires 71 and 72 and provides the means to control the flow of cleaning fluid from the cleaning fluid reservoir 11 to floor or cleaning pad through tubing member 15 thereby controlling the rate of cleaning fluid delivery.

In the illustrated embodiment, a mechanical switch to indicate that the steam mop is in the working position, for example a tilt switch or inclination sensor 73, is optionally connected to the microcontroller 54 by means of wires 74 and 75.

An accelerometer 76 is optionally connected to the microcontroller 54 by means of wires 111 and 112.

Optionally, a software algorithm can be used to control the rate of flow of fluid through the through the electromechanical fluid pump or electromechanical fluid valves 7 and 14 in response to a input signal from one or more of the sensors, such as mechanical switch, a tilt switch or inclination sensor 73 or the accelerometer 76 to indicate that the steam mop is in the working position. When the steam mop is in the working position as indicated by sensors and/or the mop is being moved back and forth as indicated by sensor 76, the microcontroller may cause the electromechanical fluid pump or electromechanical fluid valves 7 and 14 to dispense the water and clean fluids respectively. The delivery rate may be any desired rate. For example, a push/pull rate of about 45-60 strokes per minute for a the 5.5 inches× 10.5 inches cleaning pad described with reference to FIG. 1, a cleaning and disinfecting agent flow rate of between about 1 to 30 ml per minute may be preferred, and a flow rate of between about 3 to 15 ml per minute may be more preferred, and a flow rate of between about 6 to 12 ml per minute may be most preferred. Under the same operating conditions a steam delivery rate of about 2 to 60 grams per minute may be preferred, a steam rate of between about 7 to 45 grams per minute may be more preferred, and a steam delivery rate of between about 12 to 22 grams per minute may be most preferred. Alternatively, if the push/pull rate is between 30-44 strokes per minute, the preferred cleaning fluid delivery rate and steam delivery rate may be reduced by an appropriate amount, such as by about 20-25%. If the push/pull rate is between 61 to 75 strokes per minute, the preferred cleaning fluid delivery rate and steam delivery rate may be increased by an appropriate amount, such as about 15-20%.

Referring again to FIG. 5, in the illustrated embodiment, a series of user controlled switches 80, 83, 86, 89, 92, and 95 are connected to the microcontroller 54 by means of wires 81 and 82, 84 and 85, and 87 and 88, 90 and 91, and 113 and 114 respectively. The switches may be any suitable type of switch that can be incorporated onto the steam mop.

Switches 80 and 83 may provide the user with a means of increasing or decreasing the flow rate of fluid through the electromechanical fluid pump or electromechanical fluid valve 7 thereby increasing or decreasing the rate of steam generation. Switch 86 may provide a means of delivering a "burst of steam" by delivering about 2-5 ml of fluid to the water boiler 9 (or any other suitable quantity) over 2-3 seconds in addition to the normal flow rate of water. Optionally, switches 80 and 83 can also control the rate of cleaning fluid flow by having the microcontroller increase or decrease the flow rate of fluid through the electromechanical fluid pump or electromechanical fluid valve 14.

Switches 86 and 89 may provide the user with a means of increasing the flow rate of fluid through the electromechanical fluid pump or electromechanical fluid valve 14 thereby increasing or decreasing the rate of cleaning fluid delivery. Switch 92 provides a means of delivering a "burst of cleaning fluid" by delivering 1-5 ml of fluid (or any other suitable amount) to either the cleaning pad or the region in front of the cleaning pad or both.

Optionally, a series of LED lights 96, 99, 102, and 105 may be connected to the microcontroller 54 by means of wires 97 and 98, 100 and 101, 103 and 104, and 106 and 107 respectively.

LED light 96 may be a headlight for the steam mop, and may be provided on the floor nozzle or any other suitable location (e.g. the housing).

LED light 99 may be an auxiliary headlight to add additional brightness at the floor when cleaning fluid is sprayed to provide the user with visual feedback of an action.

LED 102 may provide the user with feedback when the water tank is empty which is sensed by the water boiler temperature sensor 68. For example, if the boiler temperature does not decrease in response to the microcontroller delivering water by activating the electromechanical fluid pump or electromechanical fluid valves 7 the temperature sensor 68 may indicate that water is not available. Alternatively, a float switch in the water tank can act as the sensor for the status of the water level. Alternatively, the water tank or a portion thereof can be made transparent so that the user can see the water fill level.

LED 105 may provide the user with feedback when the cleaning solution tank is empty which is sensed by a float switch 108 which is connected to the microcontroller by means of wires 109 and 110.

A master on/off switch 200 is provided in the wire 52 to cut power to the power supply 53.

Optionally, in accordance with another aspect of the teachings described herein, which may be used in combination with any other aspects including any of the forgoing embodiments, optionally, instead of providing functional components in the housing on the upper portion or other upper portions of the mop, the housing containing some, and preferably all, of the functional components (including, for example, the reservoir, heating apparatus, controllers, etc.) may all be incorporated within the floor nozzle or surface cleaning head. In this configuration, the size of the upper portion may be reduced, and it may lower the centre of gravity of the mop. Lowering the centre of gravity may make it easier for a user to maneuver the mop. This configuration may also simplify the relationship between the functional components. It will be appreciated that only some of the components may be provided in nozzle 4.

Figure 6:
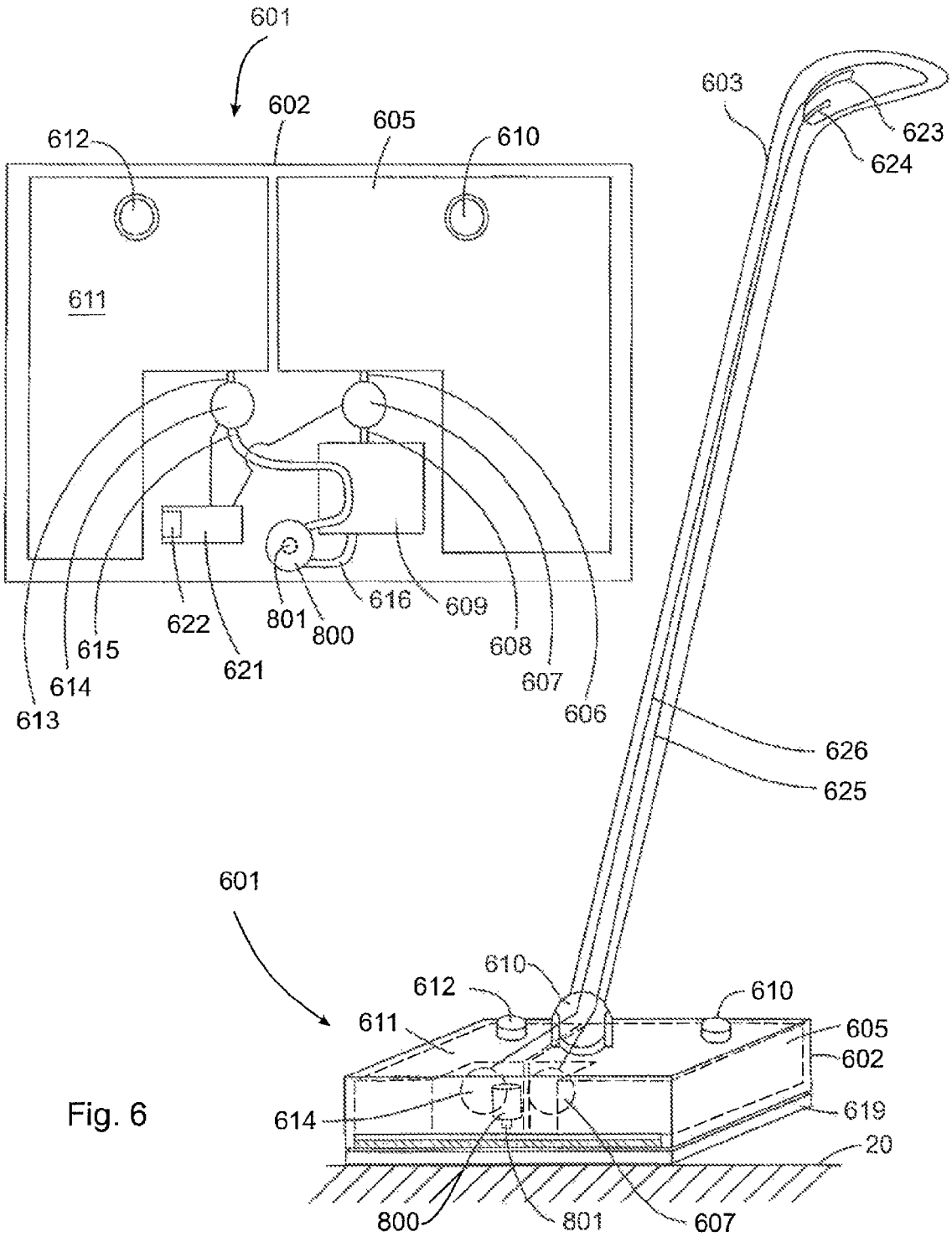
FIG. 6 is a schematic representation of a further alternative embodiment of a steam mop.

Referring to FIG. 6, a steam mop 601 is shown. The steam mop 601 is generally similar to steam mop 1, and analogous reference elements are identified using like reference characters indexed by 600. The mop 601 includes a housing 602 and a push handle 603 which incorporates an angled rotating swivel connection 618. The connection 618 may include any suitable mechanism, and preferably enables the nozzle 604 to be steered when the push handle 602 is rotated. Preferably, the push handle 603 is provided to be long enough to permit a user of the mop 601 to maneuver the housing 602 which, in this embodiment, is also the member to which the floor engaging member, e.g. the cleaning pad 612, is attached. For example, the push handle 602 may extend at least about 3 feet above the floor surface, and preferably 40 to 48 inches above the floor surface.

In this embodiment, the housing 602 is provided within the floor nozzle 604 and houses a means for heating water or an aqueous cleaning solution and a means of controlling the dispensing of this cleaning solution to the floor. In the illustrated configuration, the nozzle 604 includes the reservoirs 605 and 614 (with respective fill ports 610 and 612). The flow of water from reservoir 605 is controlled by valve 607, and the water flows into boiler 609. The flow of cleaning solution from reservoir 611 is controlled by valve 614, and the conduit 615 carrying the cleaning solution can contact the boiler 609 to heat the cleaning solution.

Flow from the reservoirs 605 and 611 onto the pad 619 may be controlled by any suitable mechanism, including a valve and/or a regulator. In the illustrated embodiment, mechanical or electromechanical valves 800 located within or adjacent to the fluid reservoirs 605 and 611 provides a means of passing controlled volumes of heated aqueous cleaning fluid from within the fluid reservoirs 605 and 611, through a penetration 801 in the lower metallic heating plate 606, and onto the cleaning pad 612. It is understood that more than one penetration 608 and/or more than one valve 607 may be provided to achieve even wetting of the cleaning pad 619.

Optionally, the mop 601 can be configured so that delivery of fluid from the reservoirs 605 and/or 611 to the pad 619 can be automatically controlled based on the use of the mop 601, for example using microcontroller 621. In the illustrated embodiment of the mop 601, in which wherein the cleaning pad is about 5.5 inches×10.5 inches, the valve 607 will preferably dispense 0.01 to 1 ml per push or pull cycle, more preferably dispense 0.03 to 0.3 ml per push or pull cycle, and most preferably dispense 0.04 to 0.08 ml per push or pull cycle. An optional trigger 613 connected by mechanism 614 to the simple mechanical lever or an electrical switch 611 is also shown. The trigger 613 allows as user to provide additional cleaning fluid on demand as required.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow. What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A surface cleaning apparatus comprising:

a) a surface cleaning head including a cleaning pad mount that is configured to receive a cleaning pad;

b) a steam distribution system including a steam unit in fluid communication with a water reservoir and having a heater and a steam outlet in communication with the cleaning pad mount;

c) a cleaning solution distribution system including a cleaning solution reservoir in communication with a dispensing outlet, wherein the cleaning solution is dispensable through the dispensing outlet without passing through the heater; and, d) a first manually controllable actuator operatively connected to the steam distribution system to selectively dispense steam, and a second manually controllable actuator operatively connected to the cleaning solution distribution system to selectively dispense cleaning solution, wherein the cleaning pad mount is moveably mounted to the surface cleaning head and the surface cleaning head further comprises a drive unit drivingly connected to the cleaning pad mount.

2. The surface cleaning apparatus of claim 1 wherein the cleaning solution comprises quaternary ammonium compounds, colloidal silver, thyme oil, cinnamon oil, rosemary oil, sage oil, acetic acid, hydrogen peroxide, tea tree oil, or a combination thereof.

3. The surface cleaning apparatus of claim 1 wherein the dispensing outlet is configured to provide the cleaning solution to a cleaning pad on the cleaning pad mount.

4. The surface cleaning apparatus of claim 1 further comprising a detector that receives a signal indicative of the usage of a cleaning pad provided on the cleaning pad mount and a controller configured to adjust the amount of at least one of steam and cleaning solution delivered based on a signal from the detector.

5. The surface cleaning apparatus of claim 4 wherein the detector comprises at least one of a detector to determine the inclination of a handle of the surface cleaning apparatus, the rate of change of the inclination of the handle, the velocity of the surface cleaning head, the rate of acceleration of the surface cleaning head and the conductivity of a cleaning pad.

6. The surface cleaning apparatus of claim 4 further comprising a manually controllable actuator operatively connected to at least one of the steam distribution system and the cleaning solution distribution system.

7. The surface cleaning apparatus of claim 4 further comprising an automatic dispensing system operatively connected to at least one of the steam distribution system and the cleaning solution distribution system and a manually controllable dispensing system operatively connected to at least one of the steam distribution system and the cleaning solution distribution system.

8. The surface cleaning apparatus of claim 7 wherein the automatic dispensing system and the manually controllable dispensing system are each operatively connected to the same distribution system.

9. The surface cleaning apparatus of claim 1 wherein the dispensing outlet comprises at least one nozzle directed downwardly at a location that is forward of the cleaning pad mount.

10. The surface cleaning apparatus of claim 1 wherein the drive unit is drivingly connected to the cleaning pad mount to move the cleaning pad mount in a plane that is essentially parallel to a surface to be cleaned.

11. The surface cleaning apparatus of claim 1 wherein the drive unit comprises at least one motor and at least one offset weight.

12. The surface cleaning apparatus of claim 1 wherein the drive unit comprises at least one of a solenoid, a sonic transducer, an ultrasonic transducer and a loudspeaker.

13. The surface cleaning apparatus of claim 1 wherein at least one of the water reservoir, the cleaning solution reservoir and a steam boiler is provided in the surface cleaning head.

14. The surface cleaning apparatus of claim 1 wherein the surface cleaning head has a height less than about 4 inches.

15. The surface cleaning apparatus of claim 1 wherein at least a portion of one of the water reservoir and the cleaning solution reservoir is transparent.

16. The surface cleaning apparatus of claim 1 wherein the steam distribution system is configured to deliver steam and/or heated water.

17. The surface cleaning apparatus of claim 1 further comprising at least one light to illuminate the water reservoir, to illuminate the cleaning solution reservoir or to illuminate an area in front of the surface cleaning head.

18. The surface cleaning apparatus of claim 1 further comprising at least one light to illuminate the water reservoir and the cleaning solution reservoir and a control system to vary the illumination when the one of the water reservoir and the cleaning solution reservoir reaches a low fluid level.

19. The surface cleaning apparatus of claim 1 further comprising a cleaning pad, wherein the cleaning pad comprises a hydrophobic material.

20. A surface cleaning apparatus comprising:

a) a surface cleaning head including a cleaning pad mount that is configured to receive a cleaning pad;

b) a steam distribution system including a steam unit in fluid communication with a water reservoir and having a steam outlet in communication with the cleaning pad mount; and, c) a cleaning solution distribution system including a cleaning solution reservoir in communication with a dispensing outlet, wherein the cleaning pad mount is moveably mounted to the surface cleaning head and the surface cleaning head further comprises a drive unit drivingly connected to the cleaning pad mount, and wherein the steam distribution system further comprises a heater and the surface cleaning apparatus further comprises a low water level detection circuit, the low water level detection circuit comprising a detector monitoring the work performed by the heater and a signal member providing a signal when the level of work performed by the heater drops below a threshold limit.

21. The surface cleaning apparatus of claim 20 wherein the detector monitors the temperature of the heater.

22. The surface cleaning apparatus of claim 21 wherein the cleaning pad comprises a hydrophobic material and a hydrophilic material.

23. The surface cleaning apparatus of claim 20 wherein the cleaning solution is dispensable through the dispensing outlet without passing through the steam unit.

24. A surface cleaning apparatus comprising:

a) a surface cleaning head including a cleaning pad mount that is configured to receive a cleaning pad;

b) a steam distribution system including a steam unit in fluid communication with a water reservoir and having a steam outlet in communication with the cleaning pad mount; and, c) a cleaning solution distribution system including a cleaning solution reservoir in communication with a dispensing outlet, wherein the steam distribution system is configured to selectively (i) deliver steam, (ii) deliver heated water, and (iii) simultaneously deliver steam and heated water.

25. The surface cleaning apparatus of claim 24, further comprising:

a first manually controllable actuator operatively connected to the steam distribution system to selectively dispense steam, and a second manually controllable actuator operatively connected to the cleaning solution distribution system to selectively dispense cleaning solution.

* * * * *